US006906685B2

(12) United States Patent
English et al.

(10) Patent No.: US 6,906,685 B2
(45) Date of Patent: Jun. 14, 2005

(54) ELECTROMAGNETIC-FIELD POLARIZATION TWISTER

(75) Inventors: Errol K. English, Beaver Creek, OH (US); Ethan C. Saladin, Centerville, OH (US)

(73) Assignee: Mission Research Corporation, Dayton, OH (US)

( * ) Notice: Subject to any disclaimer, the term of this patent is extended or adjusted under 35 U.S.C. 154(b) by 129 days.

(21) Appl. No.: 10/348,044

(22) Filed: Jan. 17, 2003

(65) Prior Publication Data

US 2003/0227417 A1 Dec. 11, 2003

Related U.S. Application Data

(60) Provisional application No. 60/349,927, filed on Jan. 17, 2002.

(51) Int. Cl.[7] ..... H01Q 15/24
(52) U.S. Cl. ..... 343/909; 343/756
(58) Field of Search ..... 343/909, 756, 343/700 MS, 797, 795, 753; H01Q 15/24

(56) References Cited

U.S. PATENT DOCUMENTS

| | | | | |
|---|---|---|---|---|
| 3,161,879 A | * | 12/1964 | Hannan et al. | 342/5 |
| 3,737,904 A | | 6/1973 | Mori et al. | |
| 3,754,271 A | | 8/1973 | Epis | |
| 3,771,160 A | | 11/1973 | Laverick | |
| 4,652,891 A | | 3/1987 | Bossuet et al. | |
| 4,728,961 A | | 3/1988 | Bossuet et al. | |
| 4,786,914 A | | 11/1988 | Wu et al. | |
| 4,926,189 A | | 5/1990 | Zaghloul et al. | |
| 5,208,603 A | | 5/1993 | Yee | |
| 5,434,587 A | | 7/1995 | Hannan | |
| 5,543,809 A | * | 8/1996 | Profera, Jr. | 343/753 |
| 5,563,614 A | | 10/1996 | Alden et al. | |
| 5,563,616 A | | 10/1996 | Dempsey et al. | |
| 5,767,789 A | | 6/1998 | Afzali-Ardakani et al. | |
| 5,959,594 A | | 9/1999 | Wu et al. | |
| 6,175,449 B1 | | 1/2001 | Menzel et al. | |
| 6,218,978 B1 | | 4/2001 | Simpkin et al. | |

OTHER PUBLICATIONS

Antonopoulos, C. et al., "Multilayer frequency–selective surfaces for millimetre and submillimetre wave applications," IEEE Proceedings—Microwaves, Antennas and Propagation, vol. 144, No. 6, Dec. 1997, p. 415–420.

Johansson, F. Stefan et al., "Frequency–Scanned Reflection Gratings with Integrated Polarizer," IEEE Transactions on Antennas and Propagation, vol. 40, No. 3, Mar. 1992, p. 331–334.

Shi, W.M. et al., "Novel Frequency–Selective Twist Polariser," Electronic Letters, vol. 27, No. 23, Nov. 7, 1991, p. 2110–2111.

PCT—International Search Report.

* cited by examiner

*Primary Examiner*—Hoanganh Le
(74) *Attorney, Agent, or Firm*—Knobbe Martens Olson & Bear LLP

(57) ABSTRACT

An apparatus and method to twist the field polarization of an electromagnetic wave over a desired frequency band is described. In one embodiment, a transmission twister rotates the polarization of a linearly-polarized incident field to produce a transmitted field. In one embodiment, the transmission twister includes a resonant polarization-twisting array between two linearly-polarized arrays. In one embodiment, the transmission twister rotates the polarization by 90 degrees. In one embodiment, the transmission twister produces low reflection of a desired incident polarization. In one embodiment, the transmission twister has a transmission coefficient (with respect to the desired incident field polarization and a correspondingly rotated transmitted field polarization) close to unity.

29 Claims, 10 Drawing Sheets

ELECTROMAGNETIC-FIELD POLARIZATION TWISTER

REFERENCE TO RELATED APPLICATION

The present application claims priority benefit of U.S. Provisional Application No. 60/349,927, filed Jan. 17, 2002, titled "ELECTROMAGNETIC-FIELD POLARIZATION TWISTER."

BACKGROUND

Description of the Related Art

A polarization twister is typically described as a device that rotates the polarization of a linear incident field by some angle (e.g., by an angle of 90 degrees). These devices are constructed using multiple non-resonant layers, each layer having an array of infinite wires. The layers are typically separated by quarter-wavelength foam spacers. The polarization of each array of infinite wires is rotated a fixed number of degrees from its preceding neighbor. Each wire grid re-radiates the component of incident E-field that is co-polarized with the grid. The polarization of the first layer is orthogonal to the incident E-field. The polarization of the next layer is slightly rotated so that a fraction of the incident field is twisted and then reflected back or transmitted forward. Since the grids are separated by a distance of ¼ wavelength, the reflected components tend to cancel, somewhat.

For many systems, where polarization purity and low reflection are desired, this crude approach is not sufficient. The performance of such polarization twisters, even when several layers are used, is inadequate for many applications. The poor performance of these devices results in the production of unwanted field components such as, for example, partial reflection of the incident field, incomplete rotation (e.g., rotation less than or greater than 90 degrees), poor transmission through the layers, etc.

SUMMARY

The present invention solves these and other problems by providing an improved apparatus and method to twist the field polarization of an electromagnetic wave, with good transmission and low reflection over a desired frequency band. In one embodiment a linearly polarized field is rotated by 90 degrees. The improved apparatus is typically thinner and less costly than the prior art because fewer layers are needed to twist the polarization while maintaining good performance characteristics.

In one embodiment, a transmission twister rotates the polarization of a linearly-polarized incident field to produce a transmitted field. In one embodiment, the transmission twister rotates the polarization by 90 degrees. In one embodiment, the transmission twister produces low reflection of a desired incident polarization. In one embodiment, the transmission twister has a transmission coefficient (with respect to the desired incident field polarization and a correspondingly rotated transmitted field polarization) close to unity.

In one embodiment, a reflection twister rotates the polarization of an electromagnetic wave having a linearly-polarized incident field to produce a reflected field with a polarization rotated with respect to the incident field. In one embodiment, the transmission twister rotates the polarization by 90 degrees.

In one embodiment, the reflection twister operates in a desired frequency band. In the operating band, an incident field (e.g., an incident E-field) is rotated from a first polarization to a second polarization with high efficiency, producing little reflected field co-polarized with the incident field. In one embodiment, the reflection twister uses a resonant polarization-twisting Frequency Selective Surface (FSS) layer above a ground plane. In one embodiment, each element of the polarization-twisting FSS includes two crossed dipoles that are connected so that one dipole loads the other dipole near its center.

It is known that a ground plane reflects Right-Hand Circular Polarization (RHCP) as Left-Hand Circular Polairzation (LHCP), and vice versa. In one embodiment, the reflection twister reflects RHCP as RHCP, and reflects LHCP as LHCP.

In one embodiment, the transmission polarization twister operates in a desired frequency band. In the operating band, an electromagnetic wave having an incident field (e.g., an incident E-field) is twisted from a first polarization to a second polarization with good efficiency, producing little or no undesired reflected field and little transmitted field co-polarized with the incident field. In one embodiment, the transmission twister uses three Frequency Selective Surface (FSS) layers arranged as a middle layer with two outer FSS layers (one on either side of the middle layer) and, optionally, two spacers. In one embodiment, the two outer FSS layers are linearly-polarized arrays (e.g., linearly-polarized wires or slots), and the middle layer is a polarization-twisting FSS array. In one embodiment, the two outer FSS layers are dipole arrays, and the middle layer is a polarization-twisting FSS array. In one embodiment, one or both of the two outer FSS layers are slot arrays, and the middle layer is a polarization-twisting FSS array of slots or wire elements. In one embodiment, one or both of the two outer FSS layers are non-resonant grids, and the middle layer is a polarization twisting FSS array. In one embodiment, each element of the polarization twisting FSS includes two crossed dipoles that are connected so that one dipole loads the other dipole near its center. In one embodiment, the middle layer is a polarization twisting FSS array comprising loop-type elements. In one embodiment, the middle layer is a polarization twisting FSS array comprising bowtie loop-type elements.

BRIEF DESCRIPTION OF THE FIGURES

The advantages and features of the disclosed invention will readily be appreciated by persons skilled in the art from the following detailed description when read in conjunction with the drawings listed below.

DETAILED DESCRIPTION

Figure 1:
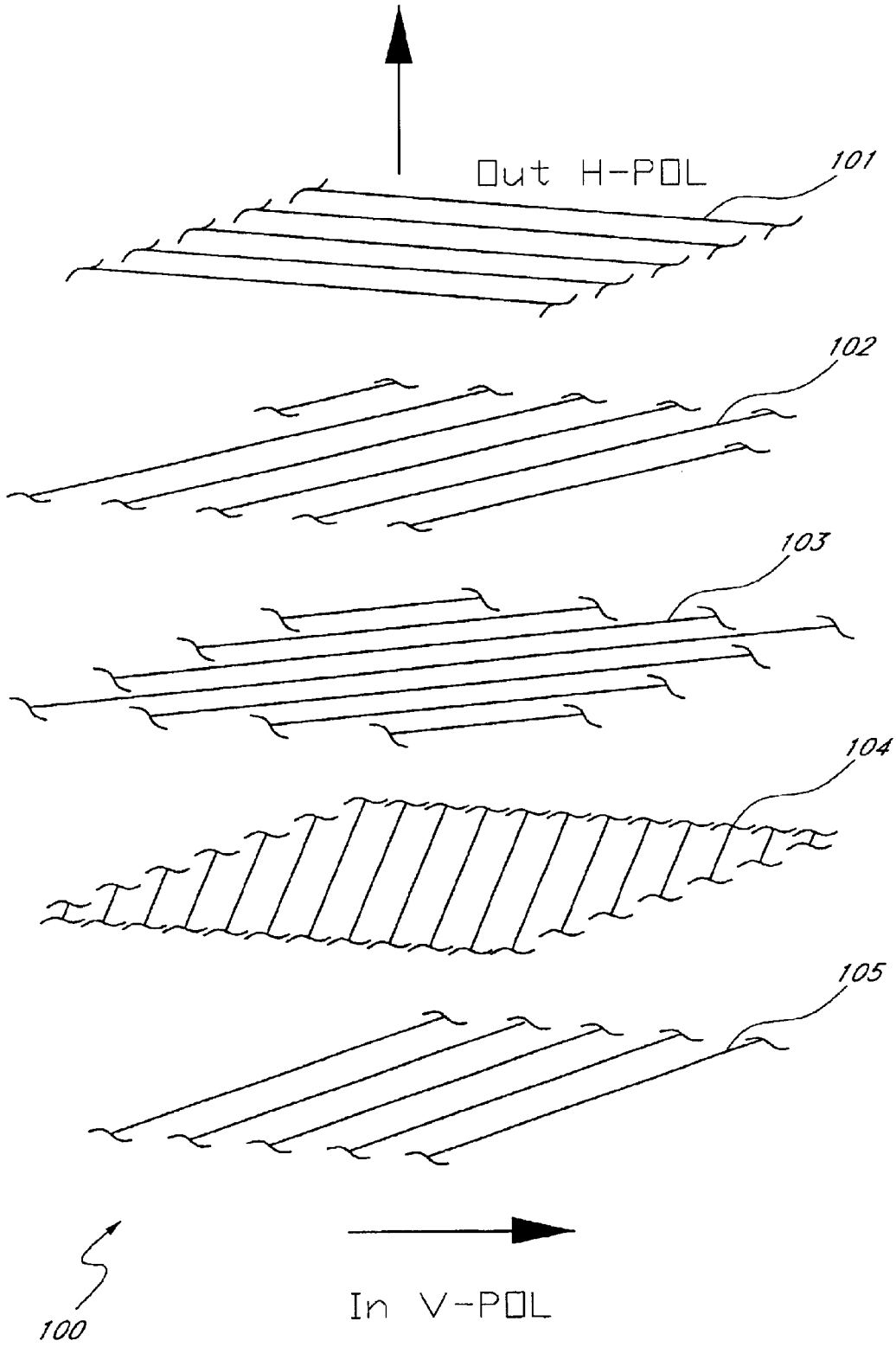
FIG. 1 (PRIOR ART)
FIG. 1 shows a five-layer polarization twister using non-resonant wire grids (sometimes called "infinite" wire grids).

FIG. 1 shows a prior art polarization twister having five non-resonant layers of wires 101–105 (sometimes called an "infinite" wire grid because the wires are long with respect to the wavelength of the incident field). The layers are non-resonant in that they do not exhibit significant resonance effects in the desired operating band. The first layer 101 is cross-polarized to the desired incident field. Each successive non-resonant layer 102–105 is rotated with respect to its preceding layer such that the final non-resonant layer 105 is co-polarized with the incident field.

Figure 2:
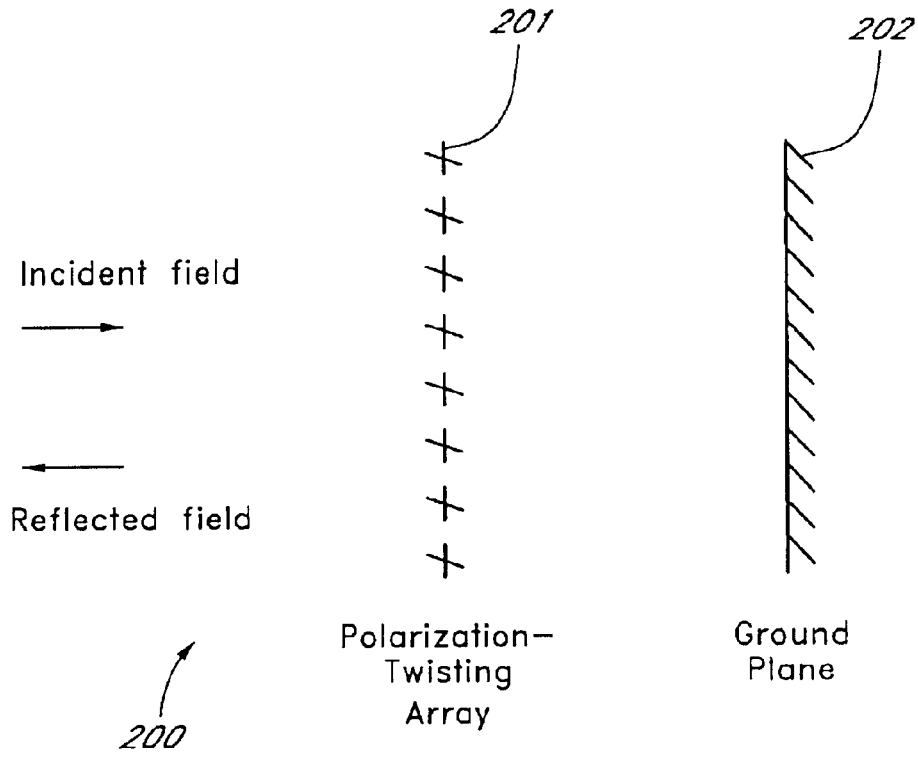
FIG. 2 shows a reflection twister.

A reflection twister is shown in FIG. 2. The reflection twister has a polarization-twisting FSS 201 (such as, for example, the polarization-twisting FSS layers shown in FIGS. 4B and/or 8B) located above a groundplane 202. The polarization-twisting FSS layer 201 rotates the polarization of an incident field to produce transmitted and reflected fields where the polarization of at least a portion of the incident field has been rotated by a desired rotation. The polarization-twisting FSS layer 201 can be constructed using FSS elements such as loaded dipoles (or slots), V dipoles (or slots), bent dipoles (or slots), asymmetrical loops (wires or slots), rectangular loops (wires or slots), dipoles (or slots) rotated by some angle (e.g., 45 degrees) with respect to the incident field, etc. In one embodiment, each polarization-twisting FSS element of the array 201 is a dipole loaded with a cross-polarized dipole. At resonance, the dipole is matched by the cross-polarized dipole load. In one embodiment, each polarization-twisting FSS element is a slot loaded with a cross-polarized slot. In one embodiment, a dielectric spacer is placed between the FSS and the ground plane. In one embodiment, the FSS 201 and/or the ground plane 202 are bonded to the dielectric spacer.

If a conjugate-matched element is located above a ground plane, then most (theoretically all) of the energy will end up in the load. In this case, the load is the cross-polarized dipole (or slot). Therefore, when the twister FSS 201 is properly located above the ground plane 202, then most of the reflected signal will be rotated 90 degrees from the incident polarization.

Figure 3:
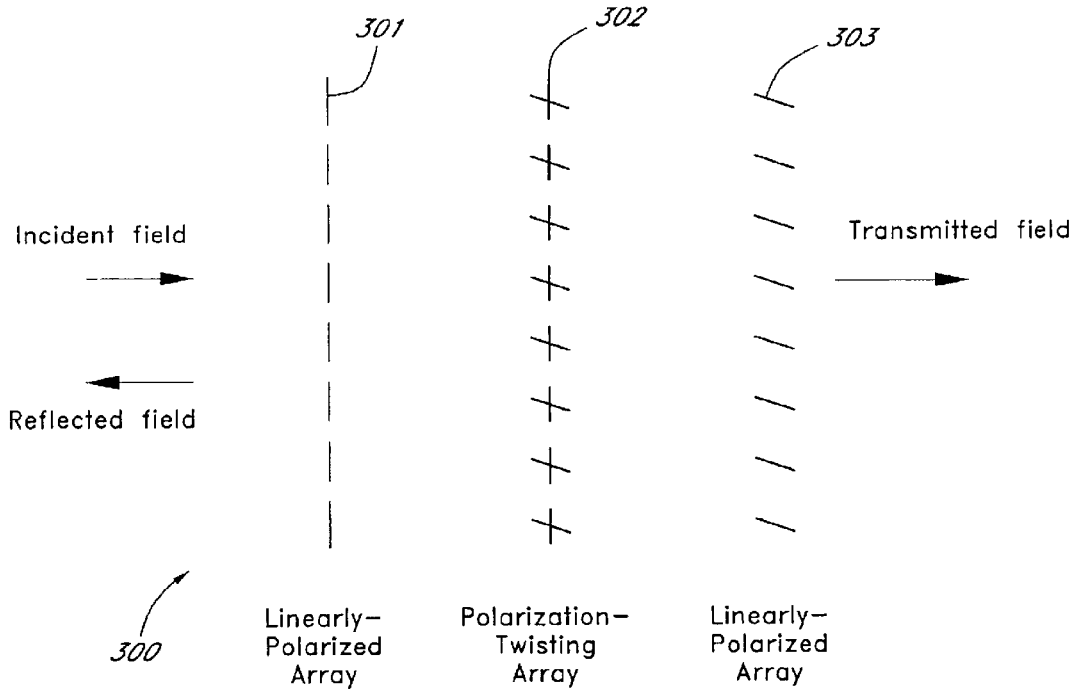
FIG. 3 shows a transmission twister.

A transmission twister 300 is shown in FIG. 3. The transmission twister 300 includes a first FSS layer 301, a second FSS layer 302, and a third FSS layer 303. The polarization of the elements of the first FSS 301 is orthogonal to the polarization of the incident field (the input polarization) such that at least a portion of the incident field can pass through the first FSS layer 301. The elements of the second FSS 302 are polarization-twisting elements. The polarization of the elements of the third FSS 303 is orthogonal to the desired transmitted polarization (the output polarization) such that at least a portion of the transmission field can pass through the third FSS layer 303. The second FSS 302 is disposed between the first FSS 301 and the third FSS 303. In one embodiment, one or more dielectric spacers are used between the FSS layers 301–303. In one embodiment, one or more of the FSS layers 301–303 are bonded to the dielectric spacers. The elements of the first FSS layer 301 can be resonant or non-resonant wires (e.g., dipole-type elements, "infinite" wires, etc.), resonant or non-resonant slots, and the like. The elements of the second FSS layer 302 can be resonant wires, slots, and the like. The elements of the third FSS layer 303 can be resonant or non-resonant wires, resonant or non-resonant slots, and the like. The first, second, and third FSS layers 301–303 need not use the same type of FSS elements. Thus, some of the FSS layers 301–303 can use slot elements and some of the FSS layers 301–303 can use wire elements (e.g., dipoles).

In one embodiment, the first FSS layer 301 is a linearly-polarized array having elements that are cross-polarized with respect to the incident field (that is, elements that allow the desired incident polarization to pass through relatively unattenuated) and co-polarized with respect to the transmitted field (that is, elements that reflect the desired transmitted polarization). In one embodiment, the second FSS layer 302 is a polarization-twisting layer that rotates the polarization of the incident field. In one embodiment, the third FSS layer 303 is a linearly-polarized array having elements that are co-polarized with respect to the incident field (that is, elements that reflect the desired incident field polarization) and cross-polarized with respect to the transmitted field (that is, elements that allow the desired transmitted polarization to pass through relatively unattenuated). The polarization-twisting FSS layer 302 can be constructed using FSS elements such as loaded dipoles (or slots), V dipoles (or slots), bent dipoles (or slots), asymmetrical loops (wires or slots), rectangular loops (wires or slots), dipoles (or slots) rotated by some angle (e.g., 45 degrees) with respect to the incident field, etc.

In one embodiment, a first dielectric spacer is placed between the first FSS layer and the second FSS layer. In one embodiment, a second dielectric spacer is placed between the second FSS layer and the third FSS layer. In one embodiment, one or more of the FSS layers are bonded to the dielectric spacers.

Figure 4A:
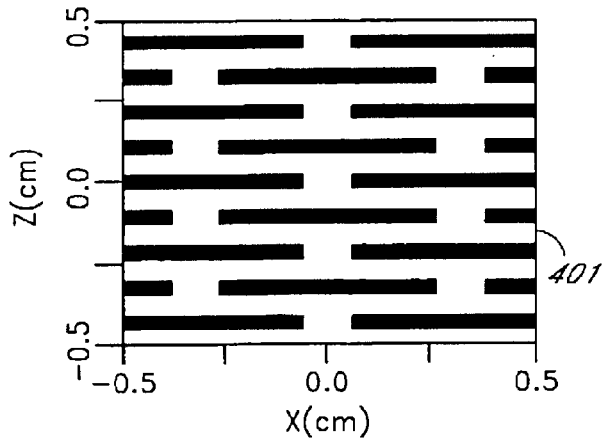
FIG. 4A shows the first FSS layer of a three-layer polarization twister using three FSS layers, where the middle layer comprises bent dipole-type elements.
Figure 4B:
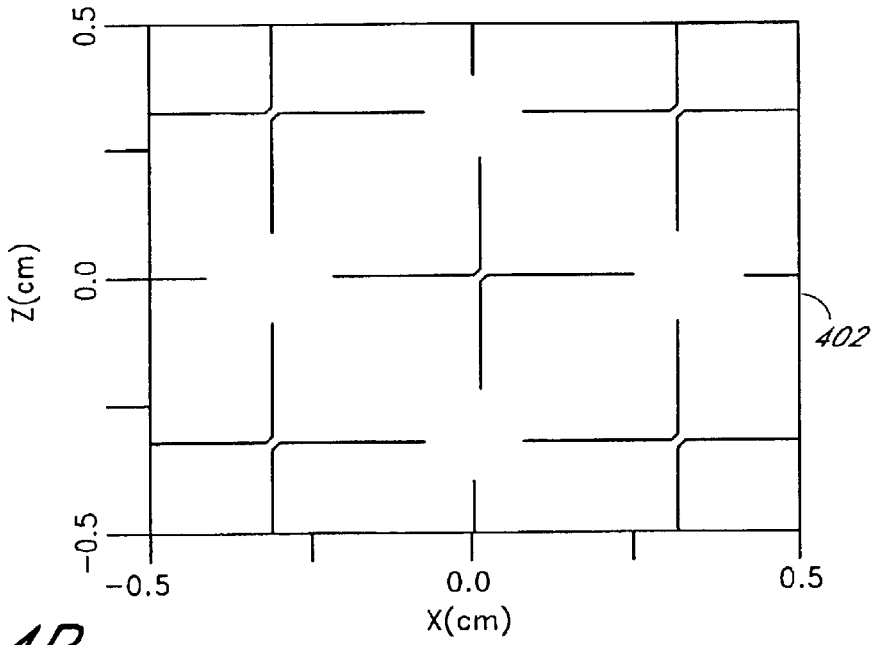
FIG. 4B shows the second FSS layer of a three-layer polarization twister using three FSS layers, where the middle layer comprises bent dipole-type elements.
Figure 4C:
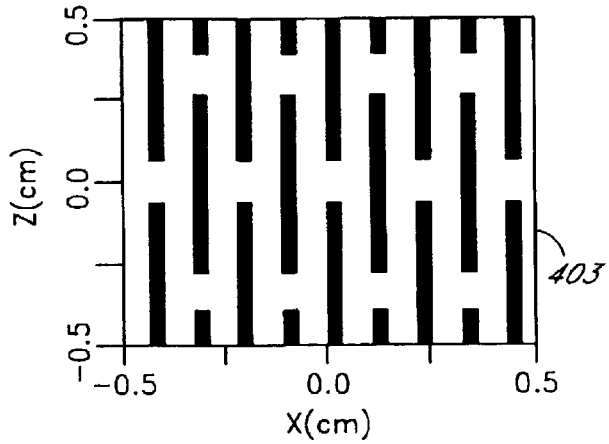
FIG. 4C shows the third FSS layer of a three-layer polarization twister using three FSS layers, where the middle layer comprises bent dipole-type elements.

FIG. 4A shows one embodiment of the linearly-polarized array 301 as a dipole FSS 401. FIG. 4B shows one embodiment of the polarization-twisting array 302, where the polarization-twisting array 302 comprises bent dipole-type elements in an FSS 402. FIG. 4C shows one embodiment of the linearly-polarized array 303 as a dipole FSS 403. The arrays shown in FIGS. 4A–4C can be used to rotate a linearly-polarized incident field by 90 degrees. FIGS. 4A and 4C show linearly-polarized dipole arrays (FIGS. 4A and 4C show dipoles, but resonant slots, non-resonant wires, or non-resonant slots can also be used). FIG. 4B shows a polarization-twisting FSS array 402 comprising bent dipole-type elements. In one embodiment, the linearly-polarized FSS layers 401, 403 is placed on each side of the polarization-twisting FSS 402. The polarization-twisting FSS array 402 comprises bent dipole-type elements arranged to form elements that can be considered to be a dipole loaded with a crossed dipole. Alternatively, the polarization-twisting FSS layer 402 can be viewed as two L-shaped elements with a gap in the center of each group of two L shaped elements. In each dipole pair the vertical dipole loads the horizontal dipole and visa versa.

The linearly-polarized dipole (or slot) FSS layers 401, 403 are broad-banded enough such that in the desired frequency band they approximate a ground plane to a first linear polarization and are approximately invisible to a second linear polarization rotated 90 degrees with respect to the first linear polarization. On the input side of the twister, the FSS elements (slots or wires) are cross-polarized to the incident E-field. On the output side of the twister the FSS elements (slots or wires) are co-polarized to the incident E-field.

As shown in the equivalent circuit model illustrated in FIG. 3, the transmission twister is conceptually analogous to two connected dipole arrays 502, 503 backed by polarization-dependent ground planes 501 504. For convenience, and without limitation to horizontal polarization (H-pol.) and vertical polarization (V-pol.), the two dipole arrays 501, 504 will be referred two as the H-pol. array and the V-pol. array. A V-pol. incident E field initially passes through the H-pol. array 501 and is then received by the vertical dipoles 502 of the polarization-twisting array. The energy is then passed from the vertical dipoles 502 to the horizontal dipoles 503 of the polarization-twisting array. The horizontal dipoles 503 of the polarization-twisting array then re-radiate (scatter) the energy forward and backward. The H-pol. ground plane 504 reflects H-pol. fields and thus prevents H-pol. radiation from the horizontal dipole array 503 from being backscattered by the polarization twister. The V-pol. ground plane 501 prevents transmission of V-pol. fields, but passes H-pol. fields with little or no attenuation. Thus, the transmission twister shown in FIG. 4 converts an incident V-pol. field into a transmitted H-pol field. If one or more of the layers can be constructed using slots instead of dipoles as discussed above. In other embodiments, a horizontal slot array can be used in place of the vertical dipole array, and vice versa.

Figure 5:
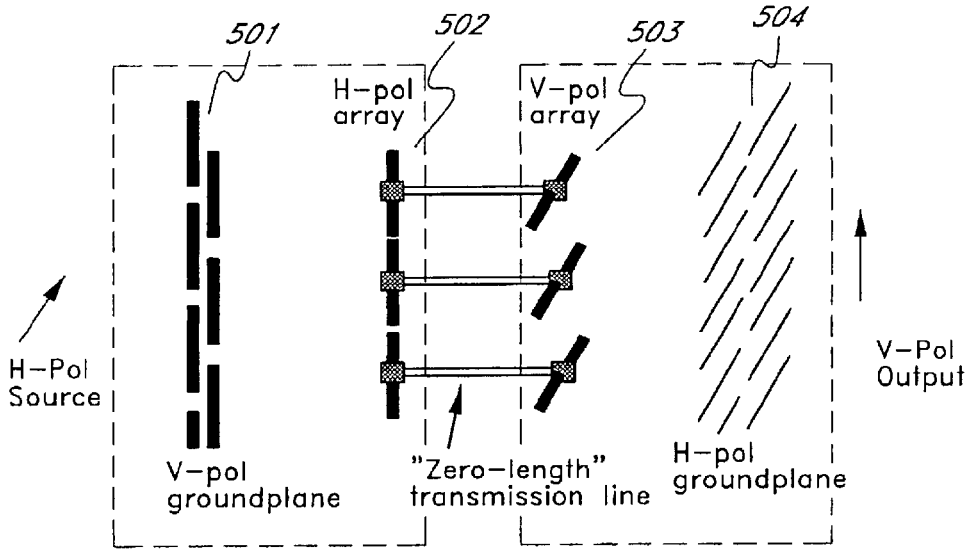
FIG. 5 shows an equivalent-circuit model of the three-layer polarization twister shown in FIGS. 4A–4C.

FIG. 5 shows predicted and measured performance of the five-layer prior art twister shown in FIG. 1. In FIG. 5, the cross-pole isolation is only 30 dB.

Figure 6:
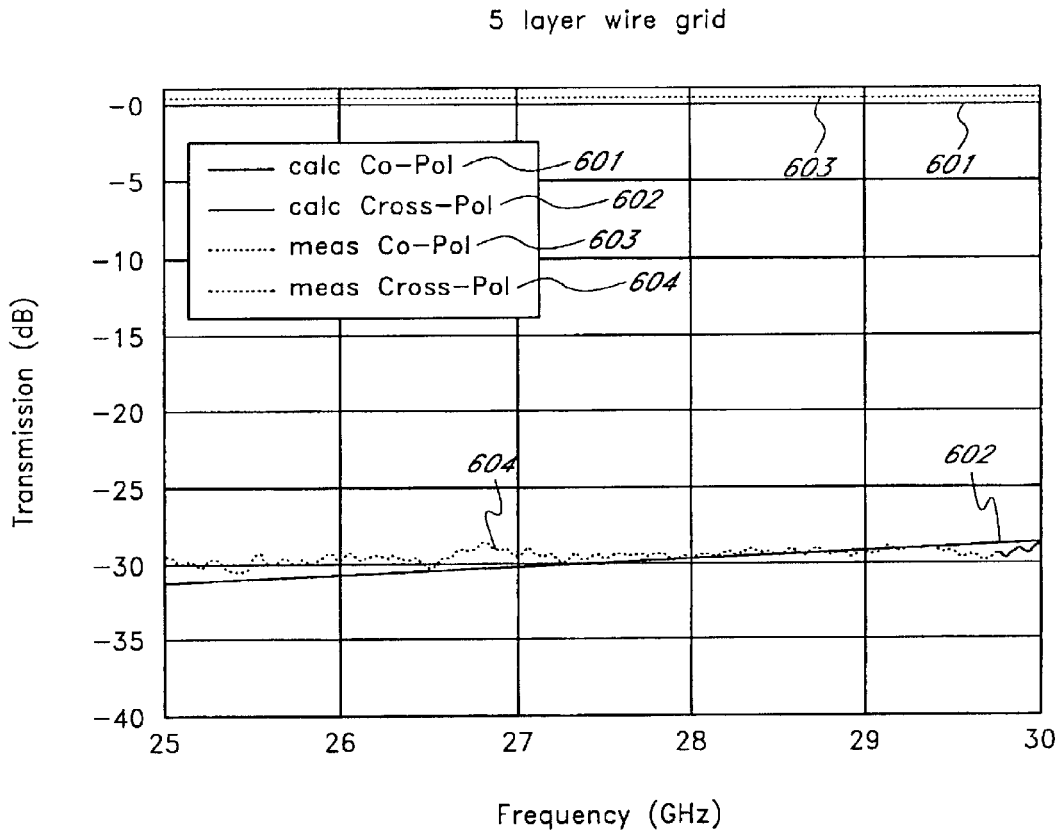
FIG. 6 shows the predicted and measured performance of the five-layer polarization twister shown in FIG. 1.
Figure 7:
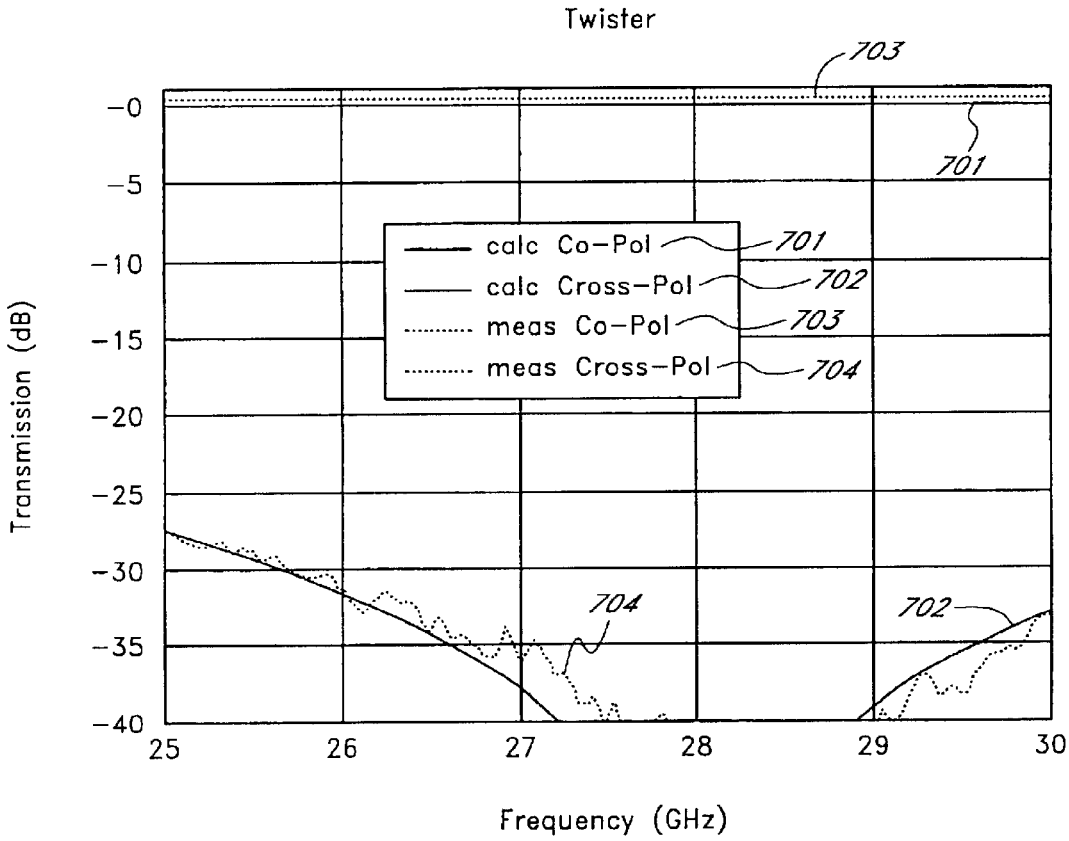
FIG. 7 shows the predicted and measured performance of the three-layer polarization twister shown in FIGS. 4A–4C.

FIG. 6 shows the predicted and measured performance of the three-layer polarization twister shown in FIGS. 4A–4C. In FIG. 6, in the operating band, the cross-pole isolation is at least 40 dB down. Thus the three-layer resonant polarization twister produces better performance, with fewer layers, than the five-layer non-resonant polarization twister.

Figure 8A:
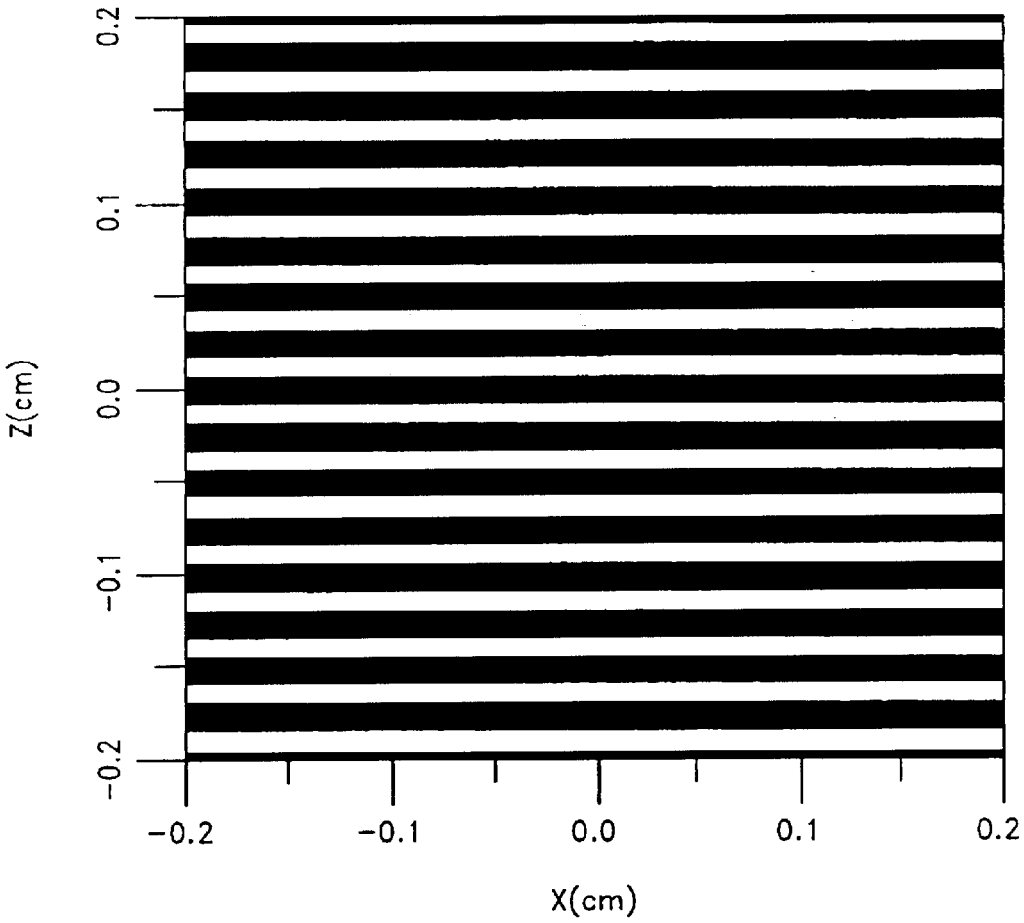
FIG. 8A shows the first FSS layer of a three-layer polarization twister using three FSS layers, where the middle layer comprises bowtie loop-type elements.
Figure 8B:
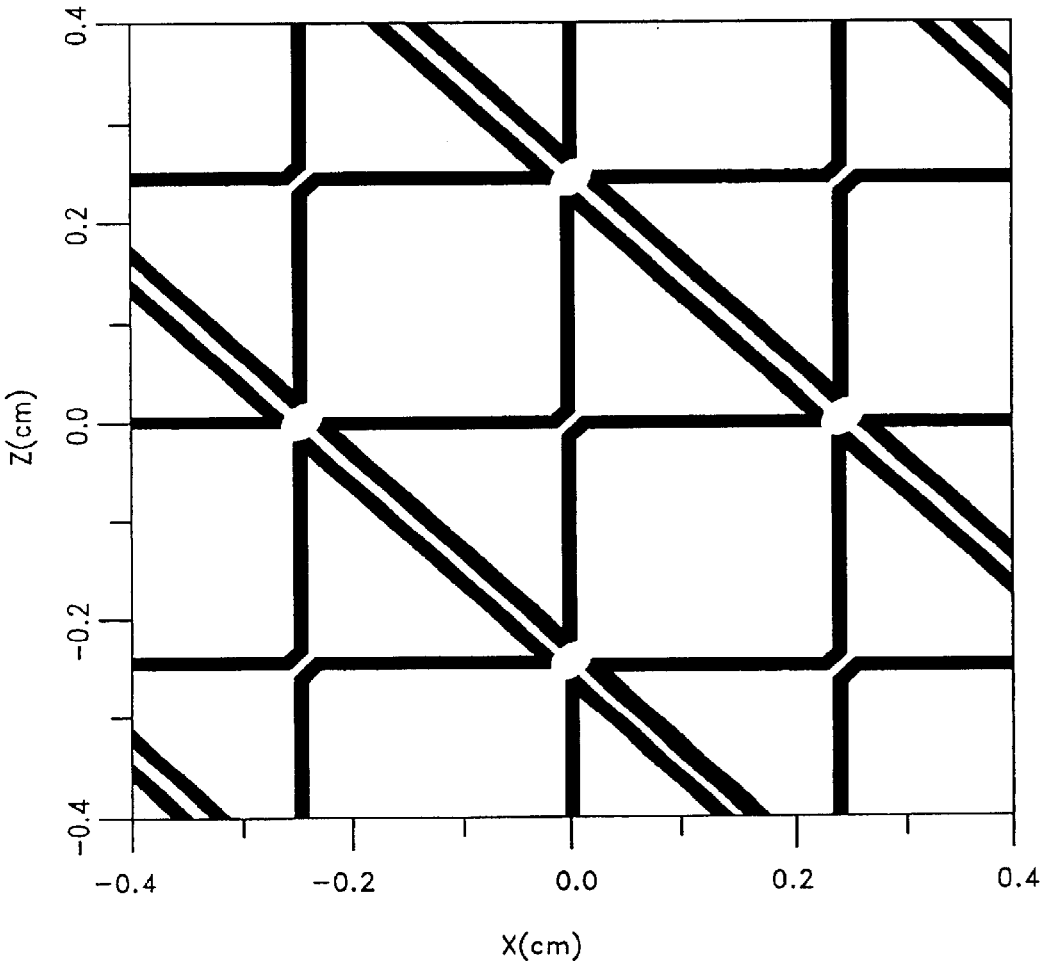
FIG. 8B shows the second FSS layer of a three-layer polarization twister using three FSS layers, where the middle layer comprises bowtie loop-type elements.
Figure 8C:
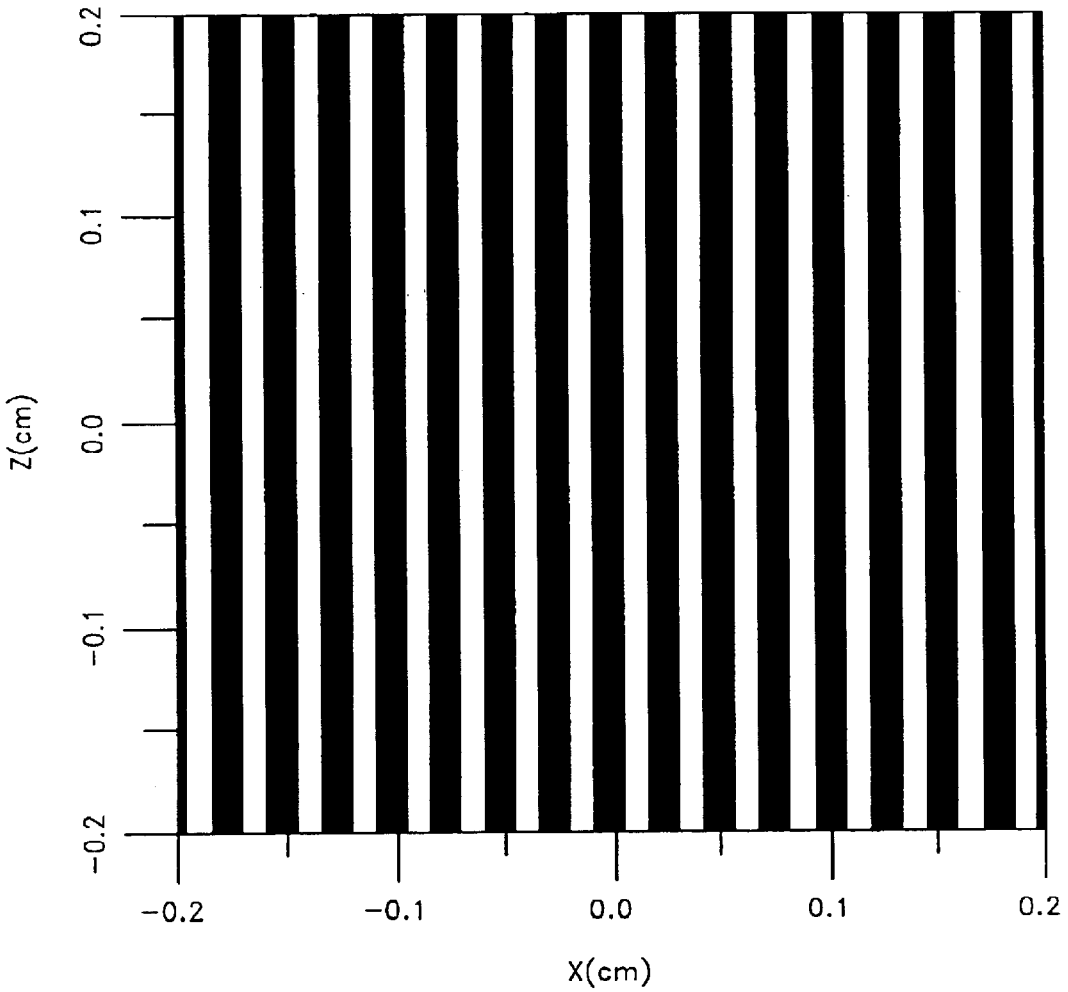
FIG. 8C shows the third FSS layer of a three-layer polarization twister using three FSS layers, where the middle layer comprises bowtie loop-type elements.

FIG. 8A shows one embodiment of the linearly-polarized array 301 as a non-resonant wire FSS 801. FIG. 8B shows one embodiment of the polarization-twisting array 302, where the polarization-twisting array 302 comprises bowtie loop-type elements in an FSS 802. FIG. 8C shows one embodiment of the linearly-polarized array 303 as a non-resonant wire FSS 803. Either or both of the wire arrays 801, 803 can be replaced by non-resonant slots arrays, resonant slot or dipole arrays, etc. The arrays shown in FIGS. 8A through 8C can be used to rotate a linearly polarized incident field by 90 degrees. FIGS. 8A and 8C show non-resonant long wire arrays 801, 803 (FIGS. 8A and 8C show non-resonant wires, but resonant dipoles, resonant slots, or non-resonant slots can also be used). FIG. 8B shows a polarization-twisting FSS array 802 comprising bowtie loop-type elements. The polarization-twisting FSS 802 array comprises loops with a generally bowtie shape. In one embodiment, the bowtie elements are similar to the dipole-type elements of FIG. 4B with the ends of the dipoles connected to form a bowtie-shaped loop.

The linearly-polarized layers 801, 803 are broad-banded enough such that in the desired frequency band they approximate a ground plane to a first linear polarization and are approximately invisible to a second linear polarization rotated 90 degrees with respect to the first linear polarization. On the input side of the twister, the wires (or slots) are polarized to allow transmission of the incident field.

Although the foregoing has been a description and illustration of specific embodiments of the invention, various modifications and changes can be made thereto by persons skilled in the art without departing from the scope and spirit of the invention.

What is claimed is:

1. An electromagnetic field polarization twister comprising:

a first frequency selective surface comprising first resonant linearly-polarized elements;

a second frequency selective surface comprising resonant, polarization-twisting, elements; and a third frequency selective surface comprising second resonant linearly-polarized elements, said first resonant linearly-polarized elements cross-polarized with respect to said second resonant linearly-polarized elements.

2. The electromagnetic field polarization twister of claim 1, wherein said first resonant linearly-polarized elements comprise dipole elements.

3. The electromagnetic field polarization twister of claim 1, wherein said first resonant linearly-polarized elements comprise slot elements.

4. The electromagnetic field polarization twister of claim 1, wherein said first resonant linearly-polarized elements comprise dipole elements, and wherein said second resonant linearly-polarized elements comprise dipole elements.

5. The electromagnetic field polarization twister of claim 1, wherein said polarization-twisting elements comprise dipoles loaded by dipoles.

6. An electromagnetic field polarization twister comprising:

a first frequency selective surface comprising elements that reflect electromagnetic fields having a first polarization and transmit electromagnetic fields having a second polarization;

a second frequency selective surface comprising elements that receive electromagnetic fields having said second polarization and scatter electromagnetic fields having said first polarization; and a third frequency selective surface comprising elements that reflect electromagnetic fields having said second polarization and transmit electromagnetic fields having said first polarization.

7. The electromagnetic field polarization twister of claim 6, wherein said first polarization is a first linear polarization and said second polarization is a second linear polarization.

8. The electromagnetic field polarization twister of claim 6, wherein said first polarization is a first linear polarization and said second polarization is a second linear polarization orthogonal to said first linear polarization.

9. The electromagnetic field polarization twister of claim 6, wherein said first frequency selective surface comprises dipole elements.

10. The electromagnetic field polarization twister of claim 6, wherein said first frequency selective surface comprises slot elements.

11. The electromagnetic field polarization twister of claim 6, wherein said first frequency selective surface comprises first dipole elements, and wherein said second frequency selective surface comprises second dipole elements.

12. The electromagnetic field polarization twister of claim 6, wherein said second frequency selective surface comprises dipole elements with dipole loads.

13. The electromagnetic field polarization twister of claim 6, wherein said first frequency selective surface comprises dipole elements and said third frequency selective surface comprises slot elements.

14. The electromagnetic field polarization twister of claim 6, wherein said third frequency selective surface comprises non-resonant wire elements.

15. The electromagnetic field polarization twister of claim 6, wherein said third frequency selective surface comprises non-resonant slot elements.

16. A method for converting a first electromagnetic wave having a first polarization into a second electromagnetic wave having a second polarization, comprising:

producing a scattered field having first components corresponding to said first polarization and second components corresponding to said second polarization, said scattered field produced in response to said first electromagnetic wave, said first electromagnetic wave propagating in a forward direction;

reflecting at least a portion of said second components that do not propagate in said forward direction; and reflecting at least a portion of said first components that propagate in said forward direction.

17. An apparatus for converting a first electromagnetic wave having a first polarization into a second electromagnetic wave having a second polarization, comprising:

means for producing a scattered field having first components corresponding to said first polarization and second components corresponding to said second polarization, said scattered field produced in response to said first electromagnetic wave, said first electromagnetic wave propagating in a forward direction;

means for reflecting at least a portion of said second components that do not propagate in said forward direction; and means for reflecting at least a portion of said first components that propagate in said forward direction.

18. A reflection twister comprising:

a frequency selective surface comprising resonant, polarization-twisting, elements; and a ground plane disposed a distance behind said frequency selective surface.

19. The reflection twister of claim 18, wherein said distance is approximately one-quarter wavelength at a desired frequency in a desired frequency band.

20. The electromagnetic field polarization twister of claim 18, wherein said polarization-twisting elements comprise first dipoles loaded by second dipoles, said second dipoles orthogonal to said first dipoles.

21. An electromagnetic field polarization twister comprising:

a first frequency selective surface comprising first resonant elements that are orthogonal to a first polarization;

a second frequency selective surface comprising polarization-twisting, elements; and a third frequency selective surface comprising second resonant elements that are orthogonal to a second polarization, said second frequency selective surface disposed between said first frequency selective surface and said third frequency selective surface, said first frequency selective surface and said second frequency selective surface separated by a first distance, said second frequency selective surface and said third frequency selective surface separated by a second distance.

22. The electromagnetic field polarization twister of claim 21, wherein said first polarization is orthogonal to said second polarization.

23. The electromagnetic field polarization twister of claim 21, wherein said first polarization is linear and said second polarization is linear.

24. The electromagnetic field polarization twister of claim 21, wherein said first distance is at least approximately equal to said second distance.

25. The electromagnetic field polarization twister of claim 21, wherein said first resonant elements comprise first dipole elements, and wherein said second resonant elements comprise second dipole elements.

26. The electromagnetic field polarization twister of claim 21, wherein said polarization-twisting elements comprise dipoles loaded by dipoles.

27. The electromagnetic field polarization twister of claim 21, further comprising a dielectric spacer between said first frequency selective surface and said second frequency selective surface.

28. The electromagnetic field polarization twister of claim 21, further comprising a dielectric spacer between said third frequency selective surface and said second frequency selective surface.

29. The electromagnetic field polarization twister of claim 21, wherein said first resonant elements comprise first slot elements, and wherein said second resonant elements comprise second slot elements.

* * * * *